US008085124B2

(12) United States Patent
Ing

(10) Patent No.: US 8,085,124 B2
(45) Date of Patent: Dec. 27, 2011

(54) ACOUSTICALLY-CONTROLLED ACCESS CONTROL INSTALLATION AND AN ACCESS CONTROL DEVICE FOR SUCH AN INSTALLATION

(75) Inventor: Ros Kiri Ing, Paris (FR)

(73) Assignee: Sensitive Object, Boulogne-Billancourt (FR)

( * ) Notice: Subject to any disclaimer, the term of this patent is extended or adjusted under 35 U.S.C. 154(b) by 330 days.

(21) Appl. No.: 11/577,087

(22) PCT Filed: Oct. 10, 2005

(86) PCT No.: PCT/EP2005/011647

§ 371 (c)(1),
(2), (4) Date: Apr. 11, 2007

(87) PCT Pub. No.: WO2006/040193

PCT Pub. Date: Apr. 20, 2006

(65) Prior Publication Data

US 2009/0224870 A1 Sep. 10, 2009

(30) Foreign Application Priority Data

Oct. 12, 2004 (FR) ..... 04 10745

(51) Int. Cl.
*G08C 19/00* (2006.01)

(52) U.S. Cl. ..... 340/5.2; 340/5.54

(58) Field of Classification Search ..... 340/5.2
See application file for complete search history.

(56) References Cited

U.S. PATENT DOCUMENTS 4,197,524 A * 4/1980 Salem ..... 340/5.51
(Continued)

FOREIGN PATENT DOCUMENTS

FR 2811107 1/2002
(Continued)

OTHER PUBLICATIONS

International Search Report for PCT/EP2005/011647. dated Dec. 15, 2005.

*Primary Examiner* — Jennifer Mehmood
*Assistant Examiner* — Naomi Small
(74) *Attorney, Agent, or Firm* — Marshall, Gerstein & Borun LLP

(57) ABSTRACT

An access control installation adapted for controlling access from a first zone to a second zone, said installation comprising: at least one separating panel separating the first and second zones, said separating panel having at least one moving closure element (1) adapted for selectively opening or closing an opening; at least one opening actuator (3*a*, 3*b*) adapted for causing the closure element (1) selectively to prevent or to allow access via the opening; and a control circuit (5) for controlling the opening actuator. Said installation further comprises at least one sound sensor (6) fastened to the separating panel on the same side as the second zone and adapted for detecting knocks on the first surface of said separating panel, and the control circuit (5) is adapted for: recognizing a predetermined code represented by a particular sequence of knocks on the first surface; and controlling the opening actuator as a function of the recognized code.

22 Claims, 2 Drawing Sheets

U.S. PATENT DOCUMENTS

| | | | | |
|---|---|---|---|---|
| 5,321,963 | A * | 6/1994 | Goldman | 70/278.1 |
| 6,411,195 | B1 | 6/2002 | Goldman | |
| 6,556,124 | B1 * | 4/2003 | Laroche | 340/5.51 |
| 6,933,930 | B2 | 8/2005 | Devige et al. | |
| 7,158,007 | B2 * | 1/2007 | Kawamoto | 340/5.64 |
| 7,345,677 | B2 * | 3/2008 | Ing et al. | 345/173 |
| 2005/0174338 | A1 | 8/2005 | Ing et al. | |
| 2005/0179588 | A1 * | 8/2005 | Kim | 342/357.07 |
| 2005/0212777 | A1 | 9/2005 | Ing et al. | |

FOREIGN PATENT DOCUMENTS

| | | |
|---|---|---|
| FR | 284022 | 12/2003 |
| WO | WO-2004/072418 | 8/2004 |

* cited by examiner

ACOUSTICALLY-CONTROLLED ACCESS CONTROL INSTALLATION AND AN ACCESS CONTROL DEVICE FOR SUCH AN INSTALLATION

The present invention relates to acoustically-controlled access control installations and to access control devices for such installations.

More particularly, the invention relates to an access control installation adapted for controlling access from a first zone to a second zone, said installation comprising:

at least one separating panel separating the first and second zones and having a first surface on the same side as the first zone and a second surface on the same side as the second zone, said separating panel having at least one opening, and at least one moving closure element adapted for selectively opening or closing the opening;

at least one opening actuator adapted for causing the closure element selectively to prevent or to allow access via the opening; and a control circuit for controlling the opening actuator.

Installations of this type are known, for example, for controlling access at a door. Such installations have a keypad built into the wall, making it possible to enter a code. When the entered code is valid, a door opening actuator, such as an electric bolt, is caused to operate, thereby unlocking the door.

Installing such an installation generally requires a space to be dug out in the separating panel (e.g. in the wall), in order to receive the keypad and/or in order to pass the cables connected to said keypad. This makes installation difficult and can cause degradation in the general appearance of the separating panel.

In addition, it can be possible to tamper with the system from the outside, by dismounting the keypad, which is accessible from the outside. Similarly, such installations can be vandalized.

A particular object of the present invention is to mitigate those drawbacks.

To this end, according to the invention, an access control installation of the type in question is characterized in that it further comprises at least one sound sensor fastened to the separating panel on the same side as the second zone and adapted for detecting knocks on the first surface of said separating panel, and in that the control circuit is adapted for:

recognizing a predetermined code represented by a particular sequence of knocks on the first surface (this sequence may optionally comprise a single knock at a predetermined location, or indeed a succession of knocks that are, for example, characterized by their absolute or relative locations and/or by their timing pattern; and controlling the opening actuator as a function of the recognized code.

By means of these provisions, the installation is easier to install and its security is improved. In addition, the outside appearance of the separating panel (e.g. a wall and a door) is substantially not changed on the first zone side.

In embodiments of the installation of the invention, use may optionally also be made of one or more of the following provisions:

the control circuit comprises recognition means adapted for comparing a signal sensed by the sound sensor with at least one predetermined signal corresponding to the signal that is sensed when a knock is generated on at least one predetermined zone belonging to the first surface of the panel, and means for associating each knock with said predetermined zone if the sensed signal is similar enough to said predetermined signal;

the code that the control circuit is adapted to recognize is constituted by a knock that is characterized by its location on the first surface;

the code that the control circuit is adapted to recognize is constituted by a sequence of a plurality of knocks that are characterized by at least one of the following characteristics: the absolute positions of the knocks of the sequence, the relative positions of the knocks of the sequence, and the timing pattern of the sequence of knocks;

the installation comprises a representation of at least one keypad key affixed to the first surface of the separating panel in register with said at least one predetermined zone;

the installation further comprises at least one keypad key including a mechanical device which, when pressure is exerted on said key, generates a knock on the first surface;

the opening actuator is provided with an auxiliary opening mechanism for opening the closure element, which mechanism can be actuated manually;

the control circuit and the opening actuator form a single control unit;

the opening actuator and the control circuit are contained in a common housing fastened to the second surface of the separating panel;

the sound sensor is received between the housing and the second separating surface;

the closure element comprises a door to which the at least one sound sensor, the opening actuator, and the control circuit are fastened;

the installation further comprises a power supply circuit connected to the mains; and the installation further comprises a power supply circuit, having an electricity source of the electrochemical type.

In addition, the invention also relates to an acoustically-controlled access control device for an acoustically-controlled access control installation, said device comprising:

at least one opening actuator; and a control circuit for controlling the opening actuator;

said acoustically-controlled access control device being characterized in that it further comprises at least one sound sensor adapted for detecting sound waves;

in that the opening actuator and the control circuit form a single control unit;

and in that the control circuit is adapted for:

recognizing a predetermined code represented by a particular sequence of sound waves (this sequence may optionally comprise a single sound wave with a predetermined origin, or indeed a succession of sound waves that are characterized, for example, by the absolute or relative locations of their origins and/or by their timing pattern); and controlling the opening actuator as a function of the recognized code.

In embodiments of the device of the invention, use may optionally also be made of one or more of the following provisions:

the sound sensor is adapted for detecting sound waves of the knock type;

the control circuit comprises recognition means adapted for comparing a signal sensed by the sound sensor with at least one predetermined signal corresponding to the signal that is sensed when a knock is generated on at least one predetermined zone; and means for associating each knock with said predetermined zone if said sensed signal is similar enough to said predetermined signal;

the code that the control circuit is adapted to recognize is constituted by a knock that is characterized by its location;

the code that the control circuit is adapted to recognize is constituted by a sequence of a plurality of knocks that are characterized by at least one of the following characteristics: the absolute positions of the knocks of the sequence, the relative positions of the knocks of the sequence, and the timing pattern of the sequence of knocks;

the device further comprises a representation of at least one keypad key;

the device further comprises at least one keypad key including a mechanical device which, when pressure is exerted on said key, generates a knock;

the opening actuator is provided with an auxiliary opening mechanism which can be actuated manually;

the opening actuator and the control circuit are contained in a common housing;

the sound sensor is received on the housing;

the device further comprises a power supply circuit connected to the mains; and the device further comprises a power supply circuit, having an electricity source of the electrochemical type.

Other characteristics and advantages of the invention appear from the following description of one of the embodiments thereof, given by way of non-limiting example and with reference to the accompanying drawings.

In the various FIGS., like references designate elements that are identical or similar.

Figure 1:
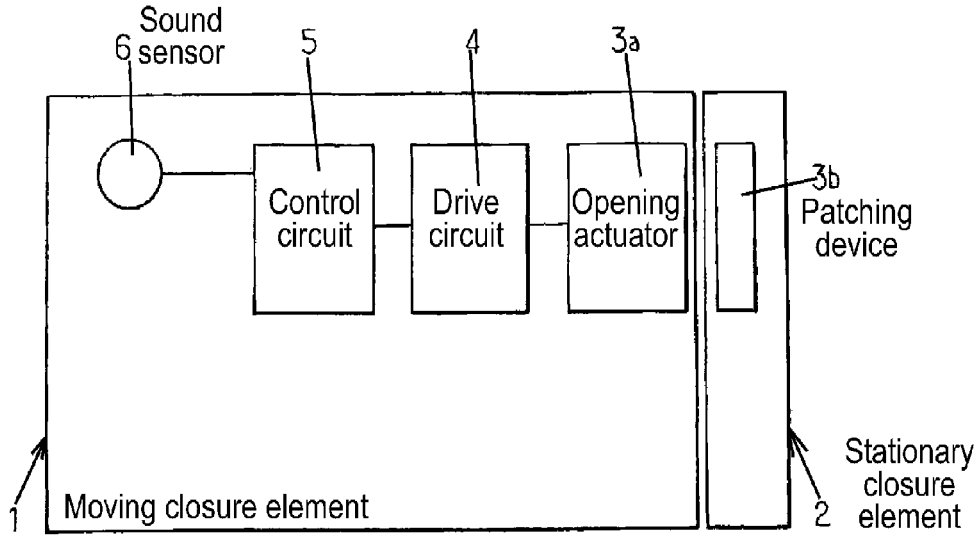
FIG. 1 is a schematic diagram of the device of the invention.

FIG. 1 shows an acoustically-controlled access control device fastened to a separating panel having a moving closure element 1, e.g. a door, and optionally a stationary complementary closure element 2 against which the closure element 1 closes. The closure element 1 prevents access from an "outside" first zone to an "inside" second zone. Said device includes an opening actuator 3*a*, such as a locking system such as a latching device, e.g. an electric bolt 3*a* locking to a corresponding latching device 3*b*.

Optionally, the opening actuator could be adapted to move the closure element 1, e.g. by means of a hydraulic or electric actuator.

The actuator 3*a* can be controlled by a control circuit 5, optionally via a drive circuit 4. The control circuit 5 can, in addition, be connected to an sound sensor 6 secured to the separating panel, optionally to the closure element 1, e.g. to the surface of said element on the inside.

The sound sensor 6 makes it possible to detect knocks generated on the separating panel, e.g. on the face of the outside side of said panel. The signals detected by the sensor 6 are transmitted to the control circuit 5 which compares them with predetermined signals in order to locate the point of knock on the surface of the outside zone side of the separating panel. If, for example, a code constituted by all of the locations of the points of knock is recognized to be valid, the control circuit 5 gives an opening order to the drive circuit 4 in order to actuate the opening actuator 3*a*.

Figure 2:
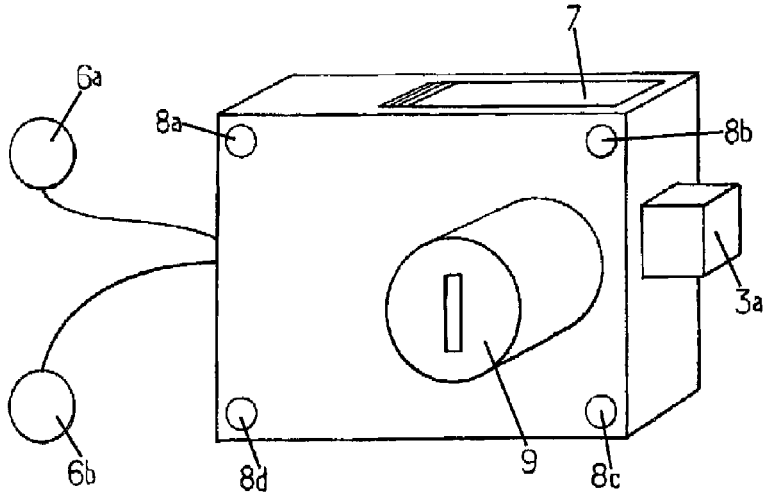
FIG. 2 shows a variant of the device shown in FIG. 1.

The control circuit 5, the drive circuit 4 and the opening actuator 3*a* can be included in a common, single control unit, and in particular be contained in a single housing as shown in FIG. 2. The housing is, in particular, provided with an opening 7 making it possible to install the batteries (rechargeable or otherwise) for powering the device. In order to fasten the housing to the separating panel, screw holes 8*a*, 8*b*, 8*c*, and 8*d* are provided. In addition, an auxiliary opening mechanism 9 such as, for example, the barrel of a lock 9 is provided for opening the door in the event that the device fails, or in an emergency. Sensors 6*a* and 6*b* are connected to the housing and are fastened to the separating panel on the inside thereof.

This device requires merely a hole to be provided for passing the auxiliary opening mechanism 9, and four screws to be tightened. Thus, installing such a device is simplified.

Figure 3:
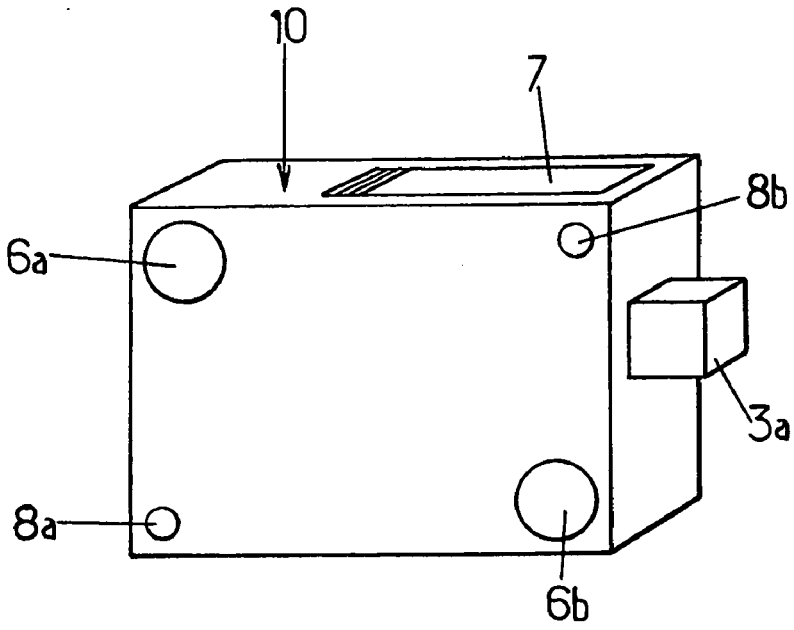
FIG. 3 shows a second variant of the device shown in FIG. 1.

It is also possible, instead of disposing the sensors 6*a* and 6*b* remotely, to fasten them to the housing as shown in FIG. 3.

In the example shown in FIG. 3, the housing is, for example, rectangular block shaped, and the face in contact with the panel is provided with the two sensors 6*a* and 6*b* at respective ones of its diagonally opposite corners, and optionally said face is provided with two holes 8*a* and 8*b* for the screws at respective ones of the remaining two corners. In order to establish contact between the sensors 6*a* and 6*b* and the surface of the inside side of the separating panel, it is possible to bond the sensors 6*a* and 6*b* thereto by means of a double-sided adhesive tape.

Optionally, thick and elastic double-sided adhesive tape is placed on the housing and the sensor 6 is bonded to said adhesive tape. The thickness of the double-sided adhesive tape is such that the sensor 6 is held in compression against the separating panel. In order to establish better contact between the sensor 6 and the inside surface of the separating panel, it is possible to bond said sensor thereto by means of a thin second adhesive tape placed between the surface of the separating panel and the sensor 6. Said thin adhesive tape can, for example, be constituted by adhesive of the epoxy type or of the silicone type.

This embodiment further simplifies installation. In addition, it limits the possibilities of vandalism being done on the sound sensors 6*a* and 6*b*. Finally, it also makes it possible to limit damage to the appearance of the door, on the inside, because it limits installation to fastening the housing.

Figure 4:
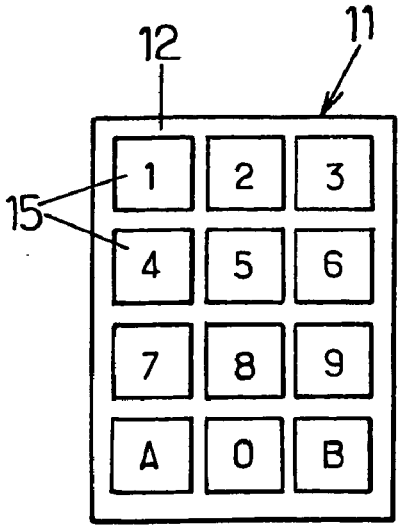
FIG. 4 is an overall view of a keypad used in an embodiment of the invention.
Figure 5:
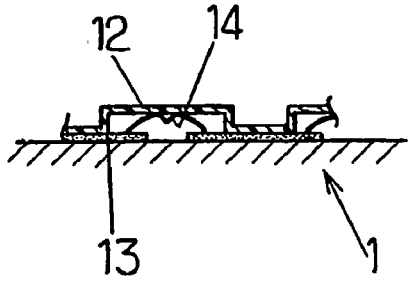
FIG. 5 is a section view of the keypad of FIG. 4.

In certain embodiments, a keypad 11, shown in FIG. 4, can optionally be fastened to the surface on the outside of the separating panel. The keypad 11 can have a certain number of keys 15, optionally distinguished by different alphanumeric characters. It can be merely be a representation of a keypad bonded to the surface on the outside side of the separating panel. It is also possible to use a keypad 11 which, as shown in FIG. 5, has a bottom membrane 13 and a top membrane 12 made of an elastic material, optionally of molded rubber. Under each of the keys 15 of the keypad, a mechanical device 14, e.g. a metal clicker, can be provided.

The mechanical device 14 is configured so that, when pressure is applied to a key of the keypad 11, said mechanical device causes a knock on the surface of the outside side of the separating panel.

Such a keypad causes almost identical knocks each time a key is actuated, thereby facilitating comparison of the knocks with the predetermined signals.

In other embodiments, no representation of a keypad is affixed to the outside surface of the separating panel.

In one embodiment, predetermined active zones can be in set positions that are not marked. The user must know where to find said predetermined zones, as a function of ornamentation on the separating panel, in order to activate said zones, e.g. in a predetermined timing pattern, i.e. in a predetermined order and/or with a predetermined rhythm.

In another embodiment, the keypad is not marked and is not defined in set manner on the door. Thus, it is the relative positions of the knocks relative to one another and their timing pattern that determine the code.

In order to initialize the device, or indeed to modify the code, provision can be made, for example, for the control circuit to go into an initialization mode when it detects a particular sequence of knocks, or optionally when the equipment is switched on. Once in the initialization mode, it can suffice to enter the agreed code, optionally on the keypad. In addition, the housing optionally has a screen forming an interface for configuration purposes.

The device can be powered by the surrounding electricity network, and it optionally has batteries enabling it to operate even in the event of a power failure.

The invention claimed is:

1. An access control installation adapted for controlling access from a first zone to a second zone, said installation comprising:

at least one separating panel separating the first and second zones and having a first surface on the same side as the first zone and a second surface on the same side as the second zone, said separating panel having at least one opening, and at least one moving closure element adapted for selectively opening or closing the opening;

at least one opening actuator adapted for causing the closure element selectively to prevent or to allow access via the opening; and a control circuit for controlling the opening actuator;

said access control installation being characterized in that it further comprises at least one sound sensor fastened to the separating panel on the same side as the second zone and adapted for detecting knocks on the first surface of said separating panel, and in that the control circuit is adapted for:

determining relative positions of the knocks on the first surface of the separating panel;

recognizing a predetermined code represented by a particular sequence of the relative position of knocks on the first surface; and controlling the opening actuator as a function of the recognized code;

the code that the control circuit is adapted to recognize comprising a sequence of a plurality of relative positions of knocks of the sequence on the first surface of the separating panel.

2. An installation according to claim 1, in which the control circuit comprises recognition means adapted for comparing a signal sensed by the sound sensor with at least one predetermined signal corresponding to the signal that is sensed when a knock is generated on at least one predetermined zone belonging to the first surface of the panel, and means for associating each knock with said predetermined zone if said sensed signal is similar enough to said predetermined signal.

3. An installation according to claim 1, in which the code that the control circuit is adapted to recognize is characterized by the timing pattern of the sequence of knocks.

4. An installation according to claim 1, further comprising a representation of at least one keypad key affixed to the first surface of the separating panel in register with said at least one predetermined zone.

5. An installation according to claim 4, further comprising at least one keypad key (15) including a mechanical device which, when pressure is exerted on said key, generates a knock on the first surface of the separating panel.

6. An installation according to claim 1, in which the opening actuator is provided with an auxiliary opening mechanism for opening the closure element, which mechanism can be actuated manually.

7. An installation according to claim 1, in which the opening actuator and the control circuit form a single control unit.

8. An installation according to claim 1, in which the opening actuator and the control circuit are contained in a housing fastened to the second surface of the separating panel.

9. An installation according to claim 8, in which the sound sensor is received between the housing and the second surface of the separating panel.

10. An installation according to claim 1, in which the closure element comprises a door to which the at least one sound sensor, the opening actuator, and the control circuit are fastened.

11. An installation according to claim 1, further comprising a power supply circuit connected to a surrounding electricity network.

12. An installation according to claim 1, further comprising a power supply circuit, having an electricity source of the electrochemical type.

13. An acoustically-controlled access control device for an acoustically-controlled access control installation, said device comprising:

at least one opening actuator adapted for causing a closure element selectively to prevent or to allow access via an opening; and a control circuit for controlling the opening actuator;

said acoustically-controlled access control device being characterized in that it further comprises at least one sound sensor fastened to a separating panel on the same side as a second zone and adapted for detecting knocks on a first surface of said separating panel;

in that the opening actuator and the control circuit form a single control unit;

and in that the control circuit is adapted for:

determining relative positions of the knocks on the first surface of the separating panel;

recognizing a predetermined code represented by a particular sequence of the relative positions of knocks on the first surface; and controlling the opening actuator as a function of the recognized code;

the code that the control circuit is adapted to recognize comprising a sequence of a plurality of a plurality of knocks of the sequence.

14. A device according to claim 13, in which the control circuit comprises recognition means adapted for comparing a signal sensed by the sound sensor with at least one predetermined signal corresponding to the signal that is sensed when a knock is generated on at least one predetermined zone belonging to the first surface of the panel; and means for associating each knock with said predetermined zone if said sensed signal is similar enough to said predetermined signal.

15. A device according to claim 13, in which the code that the control circuit is adapted to recognize is characterized by the timing pattern of the sequence of knocks.

16. A device according to claim 13, further comprising a representation of at least one keypad key affixed to the first surface of the separating panel.

17. A device according to claim 13, further comprising at least one keypad key including a mechanical device which, when pressure is exerted on said key generates a knock.

18. A device according to claim 13, in which the opening actuator is provided with an auxiliary opening mechanism which can be actuated manually.

19. A device according to claim 13, in which the opening actuator and the control circuit are contained in a housing adapted to be fastened to a surface.

20. A device according to claim 19, in which the sound sensor is fastened to the housing.

21. A device according to claim 13, further comprising a power supply circuit connected to a surrounding electricity network.

22. A device according to claim 13, further comprising a power supply circuit, having an electricity source of the electrochemical type.

* * * * *